US008029418B2

(12) United States Patent
Nishimura

(10) Patent No.: US 8,029,418 B2
(45) Date of Patent: Oct. 4, 2011

(54) PARTLY-INLAID TREADMILL

(76) Inventor: Takashi Nishimura, São Paulo (BR)

( * ) Notice: Subject to any disclaimer, the term of this patent is extended or adjusted under 35 U.S.C. 154(b) by 0 days.

(21) Appl. No.: 13/055,678

(22) PCT Filed: Jun. 4, 2009

(86) PCT No.: PCT/BR2009/000159

§ 371 (c)(1),
(2), (4) Date: Jan. 24, 2011

(87) PCT Pub. No.: WO2010/009521

PCT Pub. Date: Jan. 28, 2010

(65) Prior Publication Data

US 2011/0124466 A1 May 26, 2011

(30) Foreign Application Priority Data

Jul. 25, 2008 (BR) ..... 0802482

(51) Int. Cl.
*A63B 22/02* (2006.01)

(52) U.S. Cl. ..... 482/54; 482/4; 482/51

(58) Field of Classification Search ..... 482/54, 482/4–5, 51, 904
See application file for complete search history.

(56) References Cited

U.S. PATENT DOCUMENTS

| | | | | |
|---|---|---|---|---|
| 5,108,088 | A * | 4/1992 | Keller et al. | 482/5 |
| 5,813,947 | A * | 9/1998 | Densmore | 482/51 |
| 6,162,151 | A * | 12/2000 | Tani et al. | 482/54 |
| 6,899,659 | B2 * | 5/2005 | Anderson et al. | 482/54 |
| 2003/0134718 | A1 * | 7/2003 | Kim | 482/54 |
| 2003/0139259 | A1 * | 7/2003 | Kuo | 482/54 |
| 2005/0209062 | A1 * | 9/2005 | Anderson et al. | 482/54 |
| 2006/0040798 | A1 * | 2/2006 | Weier et al. | 482/54 |
| 2008/0058169 | A1 * | 3/2008 | Fox | 482/54 |
| 2008/0119332 | A1 * | 5/2008 | Roman | 482/54 |
| 2008/0280734 | A1 * | 11/2008 | Dickie et al. | 482/54 |
| 2009/0062072 | A1 * | 3/2009 | Packham | 482/4 |
| 2010/0248904 | A1 * | 9/2010 | Weier et al. | 482/54 |

* cited by examiner

*Primary Examiner* — Fenn Mathew
(74) *Attorney, Agent, or Firm* — Arent Fox LLP

(57) ABSTRACT

A partially-inlaid treadmill system includes a running deck, a wide belt assembled on two parallel rollers to slide over the running deck, side handrails, a panel for controlling and monitoring the treadmill system, a partition that separates a first part of the treadmill system positioned for access to the user from a second part of the treadmill system that includes mechanisms and electro-electronics for driving the belt, incline devices, belt lubrication, ventilation and regulating devices, an emergency control lever, a drawer, a plurality of directional ventilation openings, and an aisle provided on the same side of the partition as the second part of the treadmill for accessing components of the second part of the treadmill system.

9 Claims, 4 Drawing Sheets

PARTLY-INLAID TREADMILL

CROSS-REFERENCE TO RELATED APPLICATIONS

This application is the National Stage entry of International Application No. PCT/BR2009/000159, filed Jun. 4, 2009, and claims priority to Brazil Application No. PI 0802482-0, filed Jul. 25, 2008, the entire specifications, claims and drawings of which are incorporated herewith by reference.

BACKGROUND

1. Field

The present invention is directed to a partly-inlaid treadmill, and more specifically to the construction of a treadmill that makes it possible to place and use same in association with a structure, that may or may not be made of brick, so that the user may only access the control components and the treadmill itself.

2. Introduction

As is known by experts and users of treadmills, generally, in fitness centers, condominiums, clubs, among others, treadmill are placed side by side and parallel to one another in order to optimize the space.

Such conventional treadmills that are designed for jogging or running are usually comprised of a running deck, over which a wide belt that is assembled on two parallel rollers slides, the bearings of said rollers being assembled to a rigid structure, one of the driving rollers being actuated by an electric motor. Footboards are disposed on the two sides of said belt, said footboards being coated with an anti-sliding material so that the user may jump from the moving belt and step on the ground safely.

The conventional treadmills are comprised of columns attached to the structure they support and side handrail that the user may hold so that he/she may be held and improve his/her balance. In a number of treadmills, such handrail are provided with buttons for controlling the incline of the treadmill to simulate an ascending slope, buttons for controlling the speed of the belt, as well as sensing contacts for monitoring the heart rate.

In conventional treadmills, the columns also support a panel for controlling and monitoring the treadmill, where the speed and the incline of the treadmill may be changed by means of keys, thus allowing exercise programming data to be input. At the same time, through a luminous or liquid crystal display, the user receives information about the speed, incline, heart rate, distance covered, calories spent, and a number of other infortreadmillion that may be provided by the electronic equipment.

Presently, a large number of the more sophisticated treadmills are provided with a touch-screen that may display recorded television programs or video after it is set up therefore.

In treadmills, the incline system that raises the front part thereof for simulating an ascending slope has little room in the front portion of the structure that also houses the electric driving motor of the roller that actuates the belt, the frequency converter or controller to change the motor speed, magnetic switch, sensors, lubricator, electronic interface and other devices. In such conditions it is very difficult to assemble an optimum rising system, thus use is made of improvised devices that are not provided with the proper rigidity and bend elastically every time the user steps thereon, causing the panel to perform movements that are enhanced by the distance imposed by the height of the columns. The steps of a person having a body weight of 70 kg, at 10 km/h, causes impacts of about 200 kg to the running deck of the treadmill, so it is evident that the rocking of the panel is inevitable. Besides, the assembly is supported on the floor through rubber cushions, what also contributes to the movement of the chassis, columns and panel.

With regard to the aesthetics, the motor case of conventional treadmills has the lowest possible height, and its width also cannot be higher that the width of the structure. This limitation imposes the use of small size drives subject to higher strains and, therefore, more susceptible to break or get worn prematurely. To stabilize the movement of the belt that is subject to consecutive blows due to the steps of the user, it would be desirable that the moment of inertia of the spinning assembly could be raised, especially the electric motor and its flywheel and pulley, but the height of the motor case prevents same to have an optimum diameter and thus a small quantity of the precision in the linear movement of the belt is lost.

Still with reference to the small space available and the high concentration of components inside the structure of the treadmill, it can be seen that it is difficult to cool the (driving and incline) motors, the electronic voltage converter or electronic speed control, and the electronic interface to serve the panel, since the air gaps build labyrinths and the life of more fragile components is at risk if the room temperature raises.

Thus, the motor case is cooled by exchanging heat with the surrounding air of the fitness center that is ultimately removed by the air conditioning system.

Another unusual aspect of the known treadmills is the fact that the belt slides on the deck with the aid of a lubricant that is usually silicon oil or wax diluted in a solvent. At certain intervals of time, an amount of lubricant should be applied to the inner face of the belt to compensate for the evaporation loss. This replacement is either performed manually by using a syringe, or automatically by a fluid pump controlled by a timer. Vapors of the solvent and lubricant fly from the treadmill to the surrounding air. Although its toxicity is minimum, the surrounding air receives such vapors and they are inhaled by the fitness center users.

Also, it should be pointed out that the electric motor, drive and bearings of such treadmill transmit their characteristic noises to the surrounding air, and it is impossible to construct a perfectly silent treadmill.

The conventional treadmills are fed through electric wires, usually connected to contacts on the floor. When the panel displays television images, the antenna cable is added, thus, the contacts and cables should not be placed where it is difficult for people to circulate.

To fix eventual defects or regulate the treadmill, usually the panel or the motor case should be removed from the panel in order to access the components thereof. Thus, the technical assistance is only possible when cowlings are removed for providing access thereto, and in this sense it is not possible to accomplish the on site maintenance while there are users in the fitness center or club.

Aiming at solving all the problems presented by the treadmills of the state of the art, the present invention proposes a new solution that also aims at presenting a new proposal for fitness centers where partly-inlaid treadmills, through this new concept, change radically the inner arrangement of places where collective physical exercises are practiced.

Thus, one of the objects of the present invention is to provide a partly-inlaid treadmill that is not limited by the little space for both installing the incline system thereof and housing the electric driving motor that actuates the roller of the belt, the frequency converter or controller to change the speed of the motor, magnetic switch, sensors, lubricator, electronic interface and other devices.

Another object of the present invention is to provide a partly-inlaid treadmill that assures the assembly of an adequate incline system with a rigidity consistent with the strain to be applied to the treadmill, thus preventing same to bend elastically every time the user steps thereon.

Another object of the present invention is to provide a partly-inlaid treadmill that allows for the use of transmissions of suitable dimensions without interfering with the aesthetics of the equipment.

Another object of the present invention is to provide a partly-inlaid ergonomic treadmill that assures the sufficient cooling of the (driving and incline) motor, voltage converter or electronic speed control, and electronic interface to serve the panel so that the inner components of the treadmill are not overheated, thus preventing any threat to the life of more fragile components if the room temperature raises.

Another object of the present invention is to provide a partly-inlaid treadmill that minimizes the transmission of its characteristic noises to the surrounding air.

Another object of the present invention is to provide a partly-inlaid treadmill that allows for the maintenance of eventual defects, or the set up of the treadmill, even while there are users in the fitness center or club, so that the users cannot notice what is going on.

SUMMARY

Aiming at solving all the problems presented by the treadmills of the state of the art, the present invention proposes a new solution that may also bring a new proposal for fitness centers, where partly-inlaid treadmills, through this new concept, change radically the inner arrangement of places where collective physical exercises are practiced.

These and other objects and advantages of the present invention are attained by using a partly-inlaid treadmill of the type comprising running deck, over which a wide belt that is assembled on two parallel rollers slides, the bearings of said rollers being assembled to a rigid structure, one of the driving rollers being usually actuated by an electric motor, the two sides of said belt being provided with foot platforms with a non slip surface; side handrails that the user may hold so that he/she may be held and improve his/her balance also being provided and said handrails having buttons for controlling the functions and sensors for monitoring the heart rate, as well as a panel for controlling and monitoring the treadmill through which the speed and incline of the treadmill may be controlled by keys that allow for exercise programming data to be input and, at the same time, may receive information about the speed, incline, heart rate, distance covered, calories spent, and a number of other information that may be provided by the electronic equipment, also being provided a touch-screen that may display recorded television programs or video after it is set up therefore. According to the present invention, there is a partition or wall that separates the part of the treadmill destined to the users from the other part of the treadmill where the mechanisms, electro-electronics, driving and incline devices, belt lubrication, ventilation and all the regulating devices are located, said partition or wall incorporating the projection of substantially horizontal parallel handrails within the reach of the hands of the user to serve as support and main access to the control buttons; a panel for controlling and monitoring the treadmill, also having a viewfinder and control and programming keys between the handrails and above same with an emergency control lever located between the handrails; a sliding or tumbling drawer being provided below said emergency control lever, said drawer being inlaid in the wall to act as a user's objects case; the wall being provided with directional ventilation openings along the sides of the panel; an aisle that may be used only by employees who maintain and regulate the treadmills assembled on the wall or partition being defined on the back part of the wall or partition; a part of the treadmill hidden by the partition being provided, not taking into account dimensional limitations and aesthetics, with a longer and wider structure where its mechanical and electric components are exposed, without cowlings but provided, with small coverings only in the parts that may be dangerous to the staff responsible for the maintenance or set up thereof.

It is understood that other aspects of the invention will become readily apparent to those skilled in the art from the following detailed description, wherein various aspects of the present invention are shown and described by way of illustration only. As will be understood, the present invention is capable of other and different variations and its several details are capable of modification in various other respects, all without departing from the scope of the invention. Accordingly, the drawings and detailed description are to be regarded as illustrative in nature and not as restrictive.

DETAILED DESCRIPTION

Figure 1:
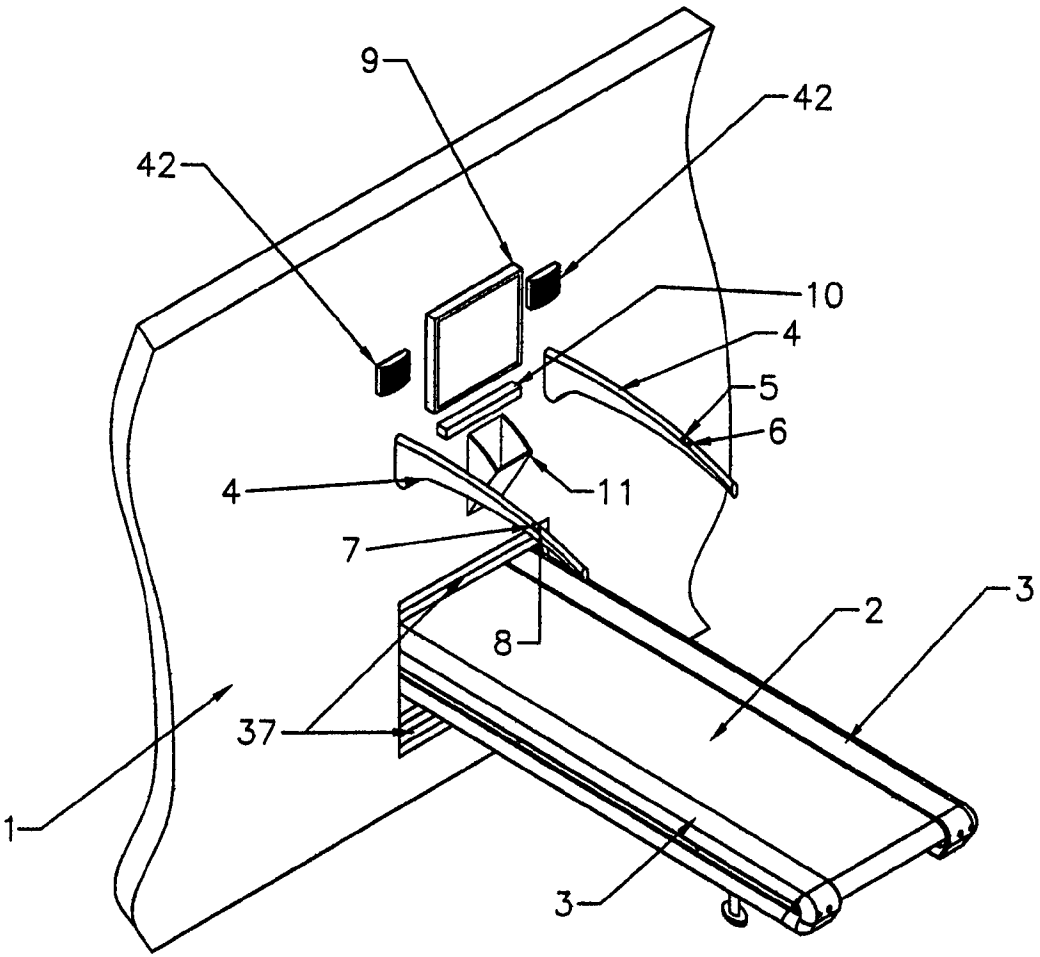
FIG. 1 depicts a partially illustrated perspective view of a wall of the fitness center, to which the treadmill object of the present invention is assembled, in accordance with some aspects of the present invention.

The partly-inlaid treadmill object of the present invention is of the type comprising a running deck, over which a wide belt 2 that is assembled on two parallel rollers 13 and 17 slides, the bearings of said rollers being assembled to a rigid structure, one of the driving rollers 13 being actuated by an electric motor 19, with foot platforms disposed on both sides of said belt 2, said foot platforms being coated with a non slip material 3; side handrails 4 that the user may hold so that he/she may be held and improve his/her balance being also provided within the reach of the user, said handrails 4 being provided with buttons 5, 6, 7, 8 for controlling functions and sensors for monitoring the heart rates, as well as a panel 9 for controlling and monitoring the treadmill, where the speed and the incline of the treadmill may be changed by means of keys, thus allowing exercise programming data to be input and at the same time, through a luminous or liquid crystal display, the user receives information about the speed, incline, frequency of heart beats, distance covered, calories spent, and a number of other information that may be provided by the electronic equipment. Also, a control touch-screen 9 may display recorded television programs or video after it is set up therefore.

In accordance with the present invention there is a partition or wall that separates or isolates the part of the treadmill destined to the users from the other part of the treadmill where mechanisms, electro-electronics, driving and incline devices, belt lubrication, ventilation and all the regulating devices are located.

In accordance with FIG. 1, the part of the treadmill may be accessed by the user comprises a projection, through wall 1, of the horizontal part of the treadmill, that consists of the wide belt 2, over which the user walks, provided with two side foot platforms 3 attached to the structure of the treadmill, for supporting the feet of the user when he/she leaves the moving belt 2, to halt the exercise. A little higher, two almost horizontal parallel handrails 4 that serve as support and main access to buttons 5, 6, 7 and 8 that control the speed and incline of the belt to simulate an ascending slope are attached to wall 1 and situated within the reach of the user hands.

The panel 9 for controlling and monitoring the treadmill is placed between handrails 4 and above same on the wall, which panel may be flat in this case, like a picture on the wall.

Said panel 9 is provided with a viewfinder and control and programming keys. In the event a touch-screen is used, control buttons will not be used, as shown in FIG. 1. Also, an emergency control lever 10 may be provided between the handrails 4, for the purpose of stopping the belt 2 in event the user is not feeling well.

A sliding or tumbling drawer 11 is arranged below said emergency control disposed on bar 10, which drawer is inlaid into wall 1, serving as a user's objects case, who normally may keep his/her cell-phone, a bottle of water and/or documents. Directional grid ventilation openings 42 are disposed beside panel 9 on wall 1.

Figure 2:
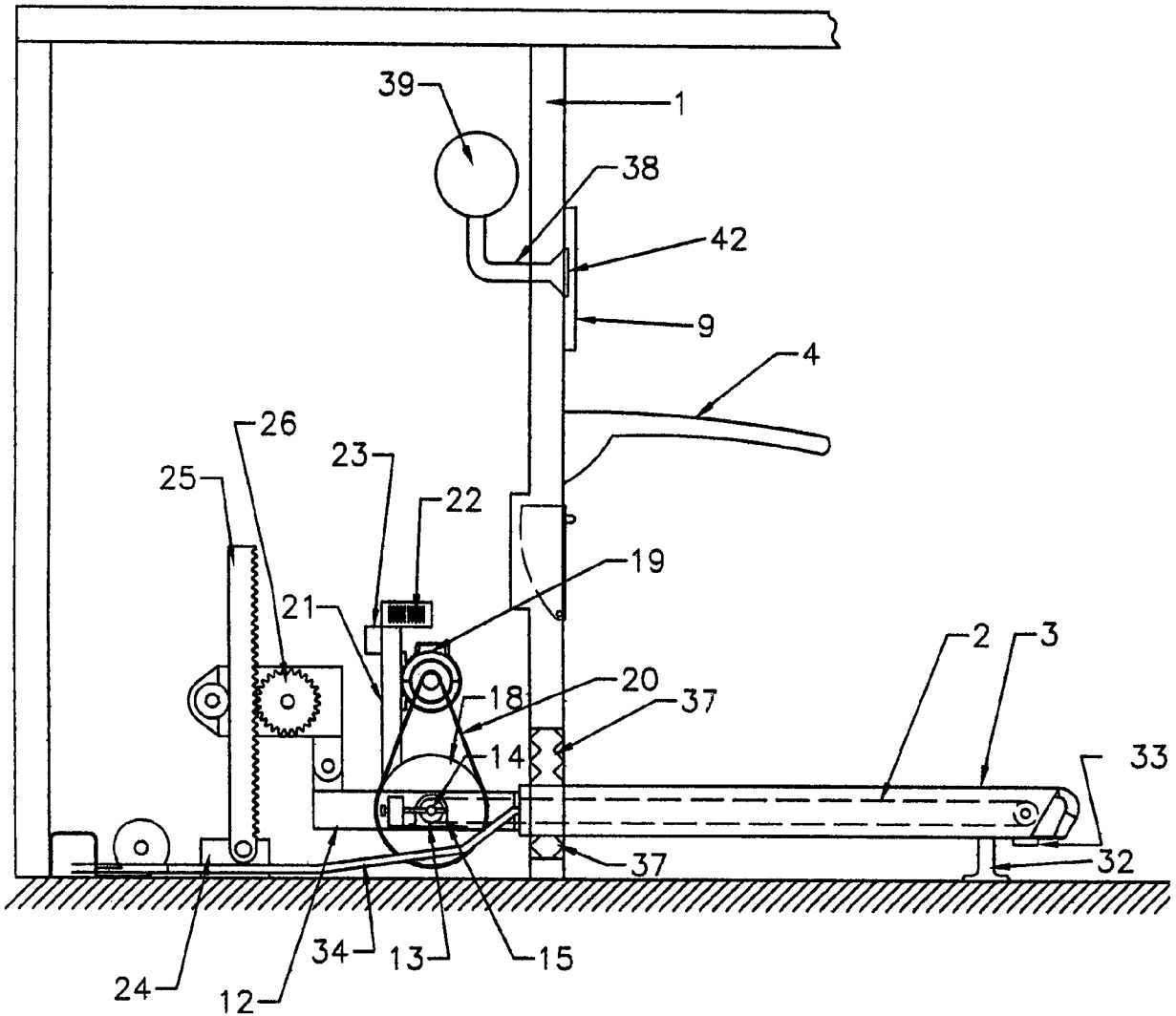
FIG. 2 depicts a side elevation view of the treadmill assembled through a wall or partition of the fitness center, in accordance with some aspects of the present invention.

In FIG. 2, the rest of the treadmill may be seen, more specifically what is behind the wall or partition 1. In spite of the fact that the figures illustrate only one treadmill assembled through wall 1, it is clear that in a fitness center a plurality of treadmills are disposed parallel to one another and assembled on the same wall or partition 1, in such a way that an aisle that may be accessed only by the employees who maintain and regulate the treadmills assembled on this wall 1 of the fitness center is defined behind said wall.

This constructive and assembly conception of the treadmill has more important characteristics that are not limited to the idea of simply cutting a treadmill in two by a wall or partition. Indeed, this constructive conception makes it possible to conceive the hidden part of the treadmill, without any concern about dimensional limitations and aesthetics, in order to have a longer and wider structure 12 where mechanical and electric components are exposed without cowlings but provided with small coverings only in the parts that may be dangerous to the authorized staff responsible for the maintenance or set up thereof.

Figure 3:
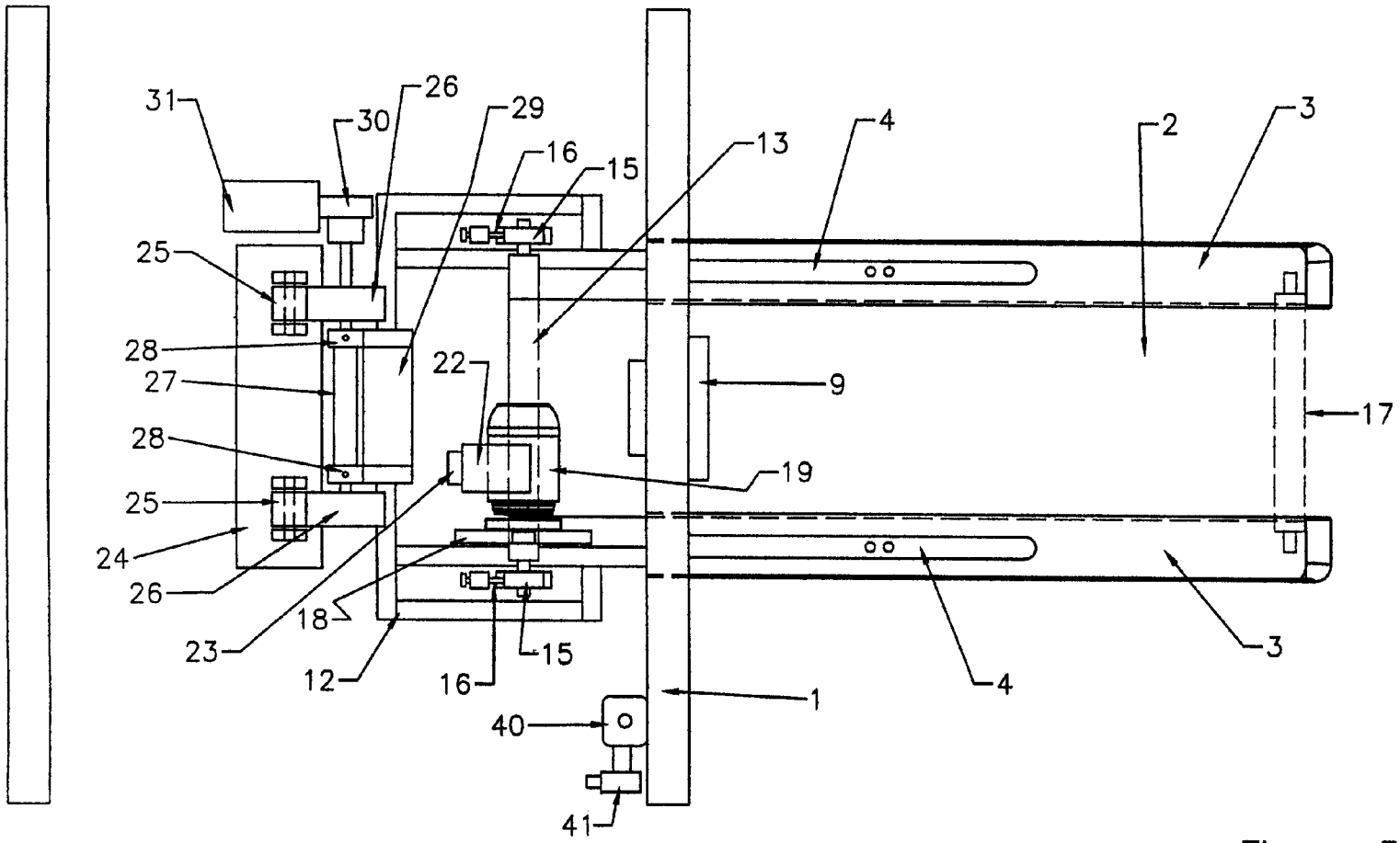
FIG. 3 depicts a plan view of the treadmill assembled on a portion of the wall or partition, in accordance with some aspects of the present invention.

Without being limited by the width or height, roller 13 that actuates belt 2 is assembled through bearings on an axle 14 provided with blocks 15 at the ends thereof, which blocks, by means of screws 16, may be moved in the direction that belt 2 is stretched, see FIG. 3. Besides straining the canvas, said screws may adjust the parallelism between roller 13 and roller 17 located at the other end of the treadmill; said roller 17 being loose and assembled through bearings and the axle fixed to structure 12. With this construction, the alignment and stretching of belt 2 are performed by the maintenance staff that may access the area outside the one the users of the fitness center have access to, said operations being carried out while a user makes exercises without noticing what is being done.

Figure 4:
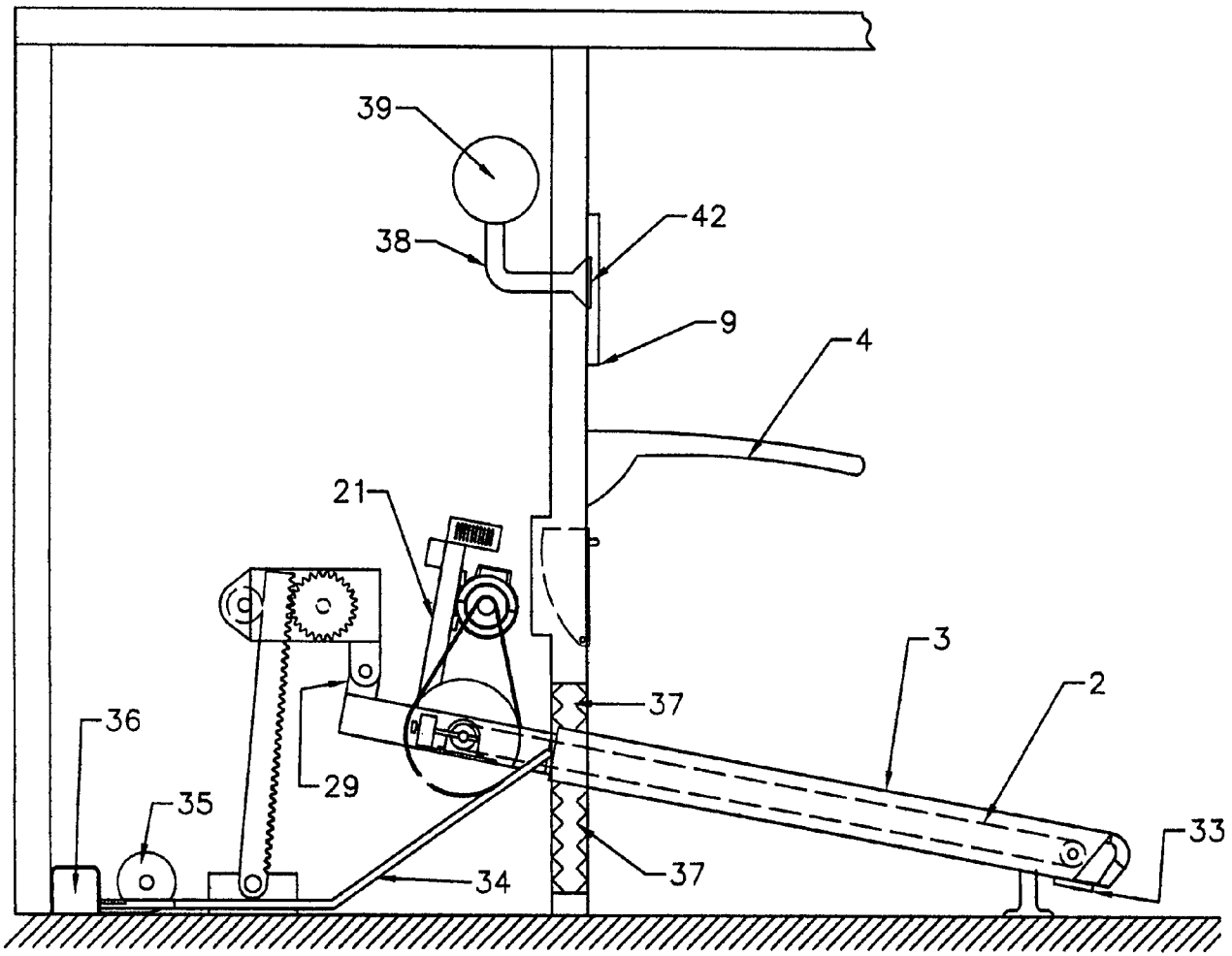
FIG. 4 depicts a side elevation view of the treadmill assembled through a wall, with a part thereof hidden from the view in the fitness center, assembled in a space designed for maintenance, in accordance with some aspects of the present invention.

Roller 13 is actuated through a pulley 18, that, in view of the lack of intrinsic limitations in treadmills, is of larger diameter and weight and useful for accumulating kinetic energy and stabilizing the speed of the belt. Because the axle 14 may be displaced horizontally, the electric motor 19 that actuates pulley 18 through belt 20 is situated above same, fixed to a vertical projection 21 of structure 12. Converter 22 or the electric motor controller 19 may be attached to said projection 21, and interface 23 that receives and sends signals to the instrument panel 9 of the treadmill. The whole structure is supported on the floor, where it may be fixed firmly through a shoe 24, where the robust incline system of the treadmill is pivoted, said system consisting of vertical racks 25 located on the front part of structure 12, and may raise or lower the same through gears 26 that are coupled to the teeth of racks 25 and are assembled on the same horizontal axle 27, with bearings 28 fixed or pivoted to a support 29 of structure 12, see FIGS. 2 and 4.

Axle 27 is moved by a speed reducer 30, to the input axle of which the motor 31 is connected and is actuated through interface 23 that receives commands from panel 9, see FIG. 3.

Although it is not shown, it should be understood that other possibilities to raise and lower the structure may be foreseen, for example, by using vertical threaded guide screws instead of racks, where the support 29 of the structure may be fastened through special nuts, said guide screws being actuated by the electric motor with a speed reducer, simultaneously rotating such guide screws by means of a roller chain or a synchronized belt.

In the area destined to the users the structure is supported on the floor by means of feet 32. Next to roller 17 the lower cover of the structure is provided with a grid window 33 through which the air inside the fitness center may penetrate, which air is inhaled through a flexible pipe 34, in the compartment behind wall 1, by an electric aspirator 35 that directs the air to a duct 36 that runs along the aisle and serves all the other treadmills and finally exhausts the air to the atmosphere. Under such conditions, all the solvent vapors and other smells of the components are removed and do not contaminate the air inside the fitness center.

So that the treadmill does not create openings in the wall through which the air may pass towards the maintenance aisle when it is raised or lowered, pleated curtains 37 are placed above and below the passage of the treadmill through the wall. Sliding panels may be adopted instead of curtains 37.

As seen in FIG. 1, directional flapped grids 42 that act as fans for the comfort of the user are assembled above handrails 4 on the user's side. Behind the wall, air ducts 38 connected to gratings 42 are attached to a duct 39 that extends along the aisle, see FIGS. 2 and 4, serving all the treadmills, and provided with a larger fan that inhales the air inside the fitness center or acclimatization system in the event the fitness center is provided with an additional temperature or moistening control system.

The automatic lubrication system of the belts of such treadmills may be centered at the maintenance aisle, provided with a single reservoir 40 (see FIG. 3) connected to an automatic pump 41, the discharge piping of which extends along the aisle, serving every treadmill, and the lubricant is dispensed by individual timed electro-valves.

Since the mechanisms positioned in the maintenance aisle are exposed, simpler devices may be used to preserve the life of the mechanical components, such as lubrication fittings on the bearings, hinges, gears, and threaded guide screws.

The electronic equipment, without being limited to size and placement, may be cooled most efficiently by larger fans and simple air flows, and may be positioned in places the maintenance staff may access easily. The electric interconnection cables may be quite simple because it is not required to use complicated harnesses that would have to go through the treadmill through passages where they would mix with moving mechanical components.

Since there is no limitation in connection with the aesthetics in the front part of the treadmill because it is hidden from the user, the distance between wall 1 and roller 13 is extended, thus generating space for placing special electric conductors that dissipate static electricity, both above and below the surface of the belt.

In the area destined to the users, the absence of moving electric and mechanical parts makes the treadmill fully safe, complying with all the international safety regulations. In view of the fact that there is no space limitation for the mechanic parts, it may fulfill the most rigorous resistance criteria, besides fulfilling the strength requirements dictated by the same international regulations.

Although not illustrated, in the event the treadmill uses pneumatic suspension, an air compressor provided with a reservoir may be placed in the maintenance aisle, having a compressed air piping that serves all the treadmills of the fitness center, each of which being only provided with individually controlled electro-valves and pressure gauges.

The object of the present invention is to change the traditional concept of a fitness center that comprises complete individual machines independent of the building, into a new concept where the user is only faced with what is useful for his/her exercises, where the electric, mechanical, pneumatic and hydraulic equipment are kept in another room that may be accessed only by the staff responsible for the maintenance and regulation thereof, wherein most of the collective ancillary equipment, irrespective of the strength and shape, fulfill the most severe criteria of electrical and mechanical construction, isolating noises and odors from the room where the exercises are practiced.

While the present invention has been described in connection with preferred aspects, it will be understood by those skilled in the art that variations and modifications of the preferred aspects described above may be made without departing from the scope of the invention. Other aspects will be apparent to those skilled in the art from a consideration of the specification or from a practice of the invention disclosed herein.

The invention claimed is:

1. A partially-inlaid treadmill system comprising:

a running deck;

a wide belt that is assembled on two parallel rollers to slide over the running deck, wherein bearings of the rollers are assembled to a rigid structure with at least one of the rollers being actuated by an electric motor;

foot platforms disposed on both sides of the belt, the foot platforms being coated with a non slip surface;

side handrails that a user may hold provided with control buttons for controlling functions and sensors for monitoring the heart rate of the user, a panel for controlling and monitoring the treadmill system provided with a viewfinder and control and programming keys;

a partition that separates a first part of the treadmill system positioned for access to the user from a second part of the treadmill system comprising mechanisms and electro-electronics for driving the belt, incline devices, belt lubrication, ventilation and regulating devices, wherein the side handrails project substantially horizontally and in parallel from the partition within a reach of the user for support and main access to the control buttons and the panel for controlling and monitoring the treadmill system is positioned on the partition between and above the handrails;

an emergency control lever located between the handrails;

a drawer provided below the emergency control lever, the drawer being inlaid in the partition;

a plurality of directional ventilation openings provided on the partition and positioned toward sides of the panel; and an aisle provided on the same side of the partition as the second part of the treadmill system for accessing components of the second part of the treadmill system.

2. The partially-inlaid treadmill system according to claim 1, wherein a front roller of the parallel rollers is assembled to a front part of the structure of the treadmill and actuates the belt via a pulley, a transmission belt, and an electric motor placed above the roller, and wherein blocks that regulate a position of an axle of the roller on the front part of the structure slide on the structure and are pulled by screws for stretching and aligning the belt.

3. The partially-inlaid treadmill system according to claim 1, wherein the incline devices raise or lower an end of the structure for simulating an ascending slope in the treadmill and comprise vertical racks coupled to gears, the gears having a common axle attached through bearings fixed to a support of the structure and actuated by an incline electric motor provided with a speed reducer.

4. The partially-inlaid treadmill system according to claim 1, wherein the aisle is provided with collective clean air units communicating a duct with air that is inhaled through the structure of the treadmill via an aspiration grid positioned near a roller of the parallel rollers; the system further comprising:

a low voltage power source and a compressed air system having a compressor and a reservoir;

a central reservoir containing lubricating fluid with a hydraulic pump;

wherein the structure of the treadmill is widened in the aisle and receives electronic equipment placed on higher parts of the structure and in an inner face of the wall.

5. The partially-inlaid treadmill system according to claim 2, wherein the pulley has a diameter and weight for accumulating kinetic energy and stabilizing a speed of the belt; and wherein the electric motor that actuates the pulley through the transmission belt is located above the front roller and fixed to a vertical projection of the structure.

6. The partially-inlaid treadmill system according to claim 5, further comprising:

a controller of the electric motor; and an interface that receives and sends signals to the panel of the treadmill system, the controller and the interface being attached to the projection.

7. The partially-inlaid treadmill system according to claim 3, wherein the common axle is moved by the speed reducer via an input axle connected to the electric motor that is actuated through an interface that receives commands from the panel.

8. The partially-inlaid treadmill system according to claim 1, wherein the structure is provided with a grid window through which air is inhaled toward a flexible pipe in the aisle by an electric aspirator that directs the air to a duct that runs along the aisle and exhausts the air to the atmosphere.

9. The partially-inlaid treadmill system according to claim 1, wherein pleated curtains are placed above and below a passage of the structure through the partition.

* * * * *